United States Patent [19]

Colombo

[11] Patent Number: 4,869,496

[45] Date of Patent: Sep. 26, 1989

[54] EQUIPMENT FOR SKI MOVEMENT SIMULATION

[76] Inventor: Ottavio Colombo, Piazza Quarelli 4, S. Michele Mondovi' (Cn), Italy

[21] Appl. No.: 205,650

[22] Filed: Jun. 13, 1988

[51] Int. Cl.[4] ..... A63B 69/18

[52] U.S. Cl. ..... 272/97; 434/253

[58] Field of Search ..... 272/97, 144, 127, 70, 272/69, 132, 96; 434/253

[56] References Cited

U.S. PATENT DOCUMENTS 4,044,153 10/1985 Babcock ..... 272/97
4,595,195 6/1986 Miehlich ..... 272/97

FOREIGN PATENT DOCUMENTS 2581551 11/1986 France .
0443088 2/1968 Switzerland ..... 272/97

*Primary Examiner*—S. R. Crow
*Attorney, Agent, or Firm*—Fleit, Jacobson, Cohn, Price, Holman & Stern

[57] ABSTRACT

A piece of equipment for the simulation of skiing movements which comprises a basic structure which can be stably placed on the ground. An arm is hinged to the basic structure in a median position and is able to oscillate horizontally. The arm carries a pair of boards at its end. Feet are connected to the structure to incline it with respect to the ground. The arm is able to carry out a slight vertical oscillation. The boards are restrained to the arm so that they can rotate around their vertical and horizontal axes, the rotation around the vertical axis being limited by suitable means. Two rods overhang and are connected to the arm by pins. The rods are able to rotate around the vertical axis of these pins, such rotation being made synchronous with that of the boards. The rotation is opposite to the direction of oscillation of the arm. The piece of equipment is also equipped with an electrical detection circuit which detects correct or incorrect movements carried out by the user who, by placing his or her feet on the boards and gripping the rods, gives an oscillating movement to the arm with the help of elastic devices which absorb and give back the kinetic energy produced, thus carrying out the movements required by skiing techniques.

15 Claims, 4 Drawing Sheets

EQUIPMENT FOR SKI MOVEMENT SIMULATION

This invention relates to an improvement in equipment for Alpine ski movement simulation. The invention comprises an oscillating arm movable in a more or less horizontal plane, and also in a vertical plane. The device includes a board and sticks which correspond respectively to skis and ski poles or sticks, to which osicllation of the user's arm is transmitted so that the user, placing his or her feet on the board and holding the ski sticks, is able to make the movements used in skiing. Certain equipment for the simulation of Alpine skiing is already known, in particular a piece of equipment (FR251551) which comprises a support fixed to the ground. Two arms are articulated together with the boards with a handlebar support placed in a median position. The arms articulated with the structure are able to oscillate to the left and the right following a semi-elliptic trajectory. The arms are helped by elastic means which absorb and give back movement to provide an oscillatingg movement. The boards are also articulated with respect to the arms so that they can rotate on the horizontal axis. This piece of equipment, although it allows simulation of the main movements of skiing, has a inconvenience in that the user is made to use movements which are incorrect, as the boards cannot be directed to follow an ideal curve. Also, it is not possible to see that the support, with the handle bar, which should operate as the ski poles or sticks, synchronically follows the oscillation of the boards, which is essential for correct positioning of the body when following a curve. The object of this invention is to make a piece of equipment for simulation of the movements of Alpine skiing free from the above-described inconveniences. This object has been achieved by providing a piece of equipment for simulating skiing movements in which: the basic structure can be placed on the ground in a stable manner; means for inclination with respect to the ground are provided; and a mobile arm hinged in a median position with respect to the basic structure, able to oscillate horizontally with respect to the ground and, at the same time, capable of a slight vertical oscillation is provided.

A pair of boards are provided. The pair of boards act as skis on which the user places his feet, and are supported by the arm near its free end and connected to the same by a connection which allows rotation around the horizontal and vertical fulcrum axes. Means are provided to limit the rotation of the boards around the horizontal axis to a maximum angle between 15° and 30°.

A pair of vertical sticks (acting as ski poles or sticks) with an overhang-type connection to hinges on the arm are provided at a position which allows the user to grip and rotate them around the vertical axis of the hinges.

Means are provided to transmit the horizontal oscillating movement of the arm with respect to the ground to the boards and sticks. Such means give the sticks and the boards a synchronous movement around the vertical axis, opposite to the direction of oscillation of the arm.

Means are further provided to give the boards a smaller rotation on the vertical axis when their rotation on the horizontal axis is greater than an angle between 10° and 25°.

Elastic means placed at the sides of the arm between this and the basic structure absorb the kinetic energy produced and return the energy at the end of travel of the arm. The elastic means thus inverts the direction of horizontal oscillation of the arm itself with respect to the ground.

An electrical detector circuit, made up of electrical contacts which are triggered by the mobile arm, boards and vertical sticks, and luminous or acoustic wornings, are preferably provided. The warnings are provided by a part of the structure in a panel which is in front of the user. The wanings signal wrong movements or movements carried out with the wrong timing on the part of the user.

Because of these characteristics, a piece of equipment which gives the most realistically possible simulation of movements used when skiing is provided. Also, the user is given the possibility of checking the correctness of the movements carried out, because of the presence of the electrical detection circuit.

BRIEF DESCRIPTION OF THE DRAWINGS

Other characteristics and advantages of this invention are clearly evident in the detailed description of a non limitative example which follows and with reference to the enclosed drawings in which.

DESCRIPTION OF THE PREFERRED EMBODIMENT

Figure 1:
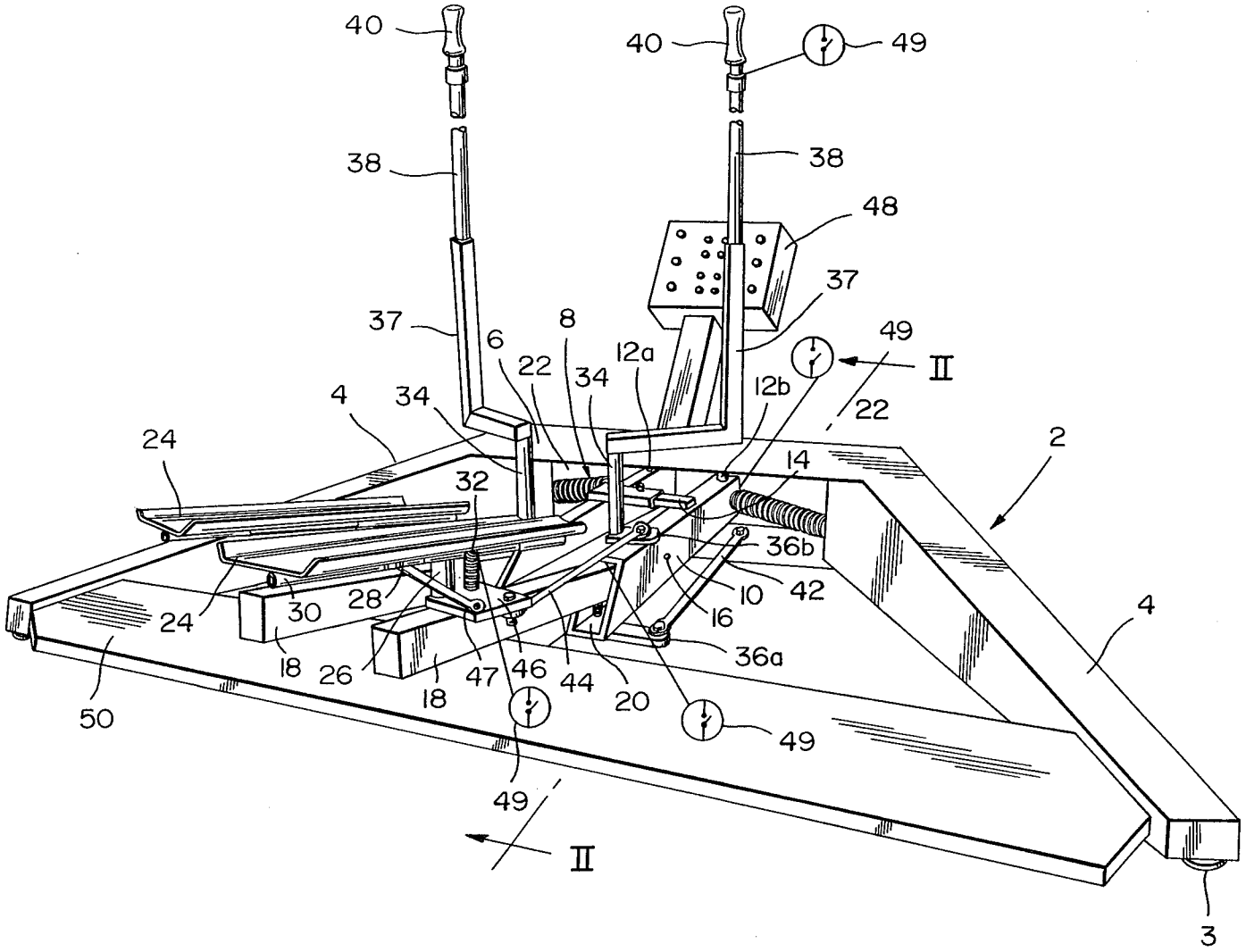
FIG. 1 is a perspective view of an entire piece of equipment for simulation of skiing movements, according to the present invention.
Figure 2:
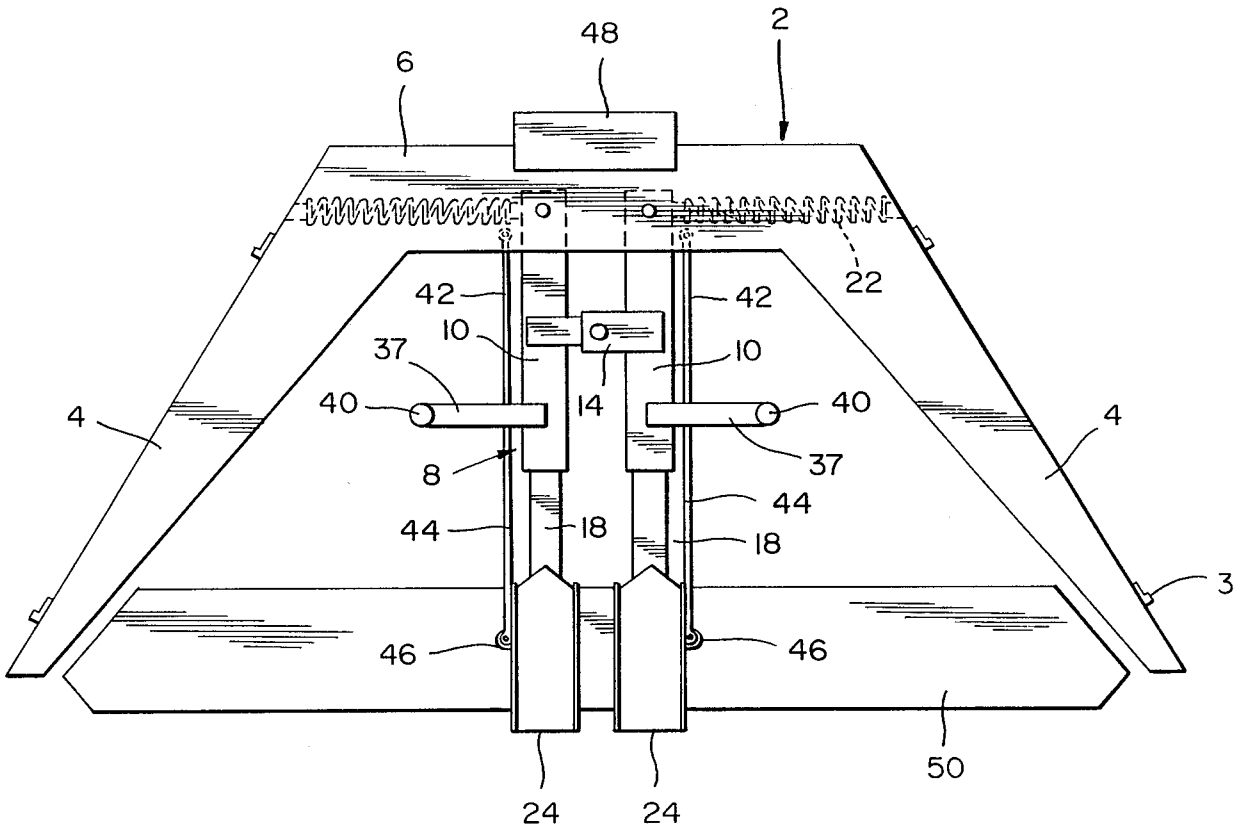
FIG. 2 is a top view of FIG. 1.
Figure 3:
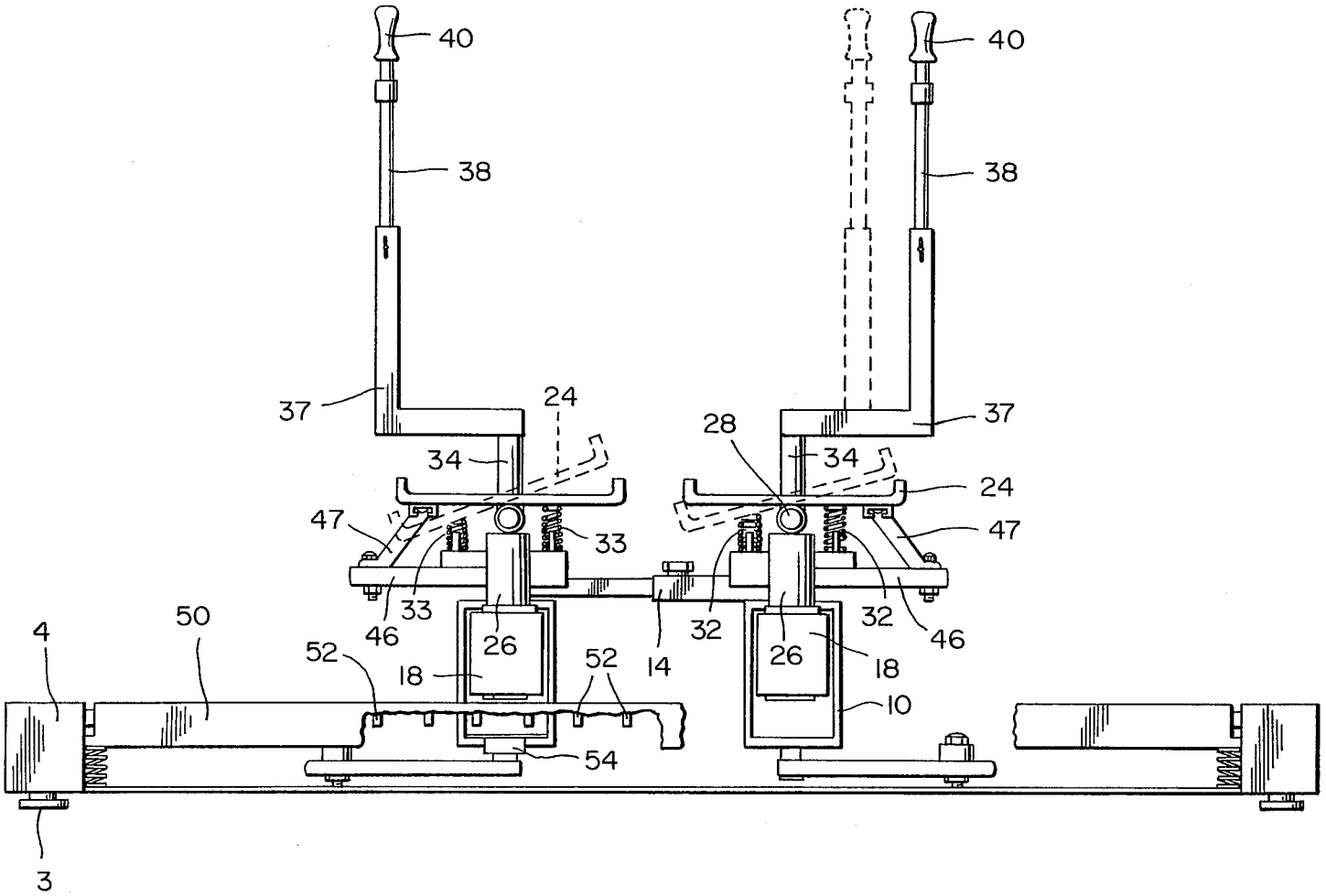
FIG. 3 is a schematic, rear view of the machine of FIG. 1.
Figure 4:
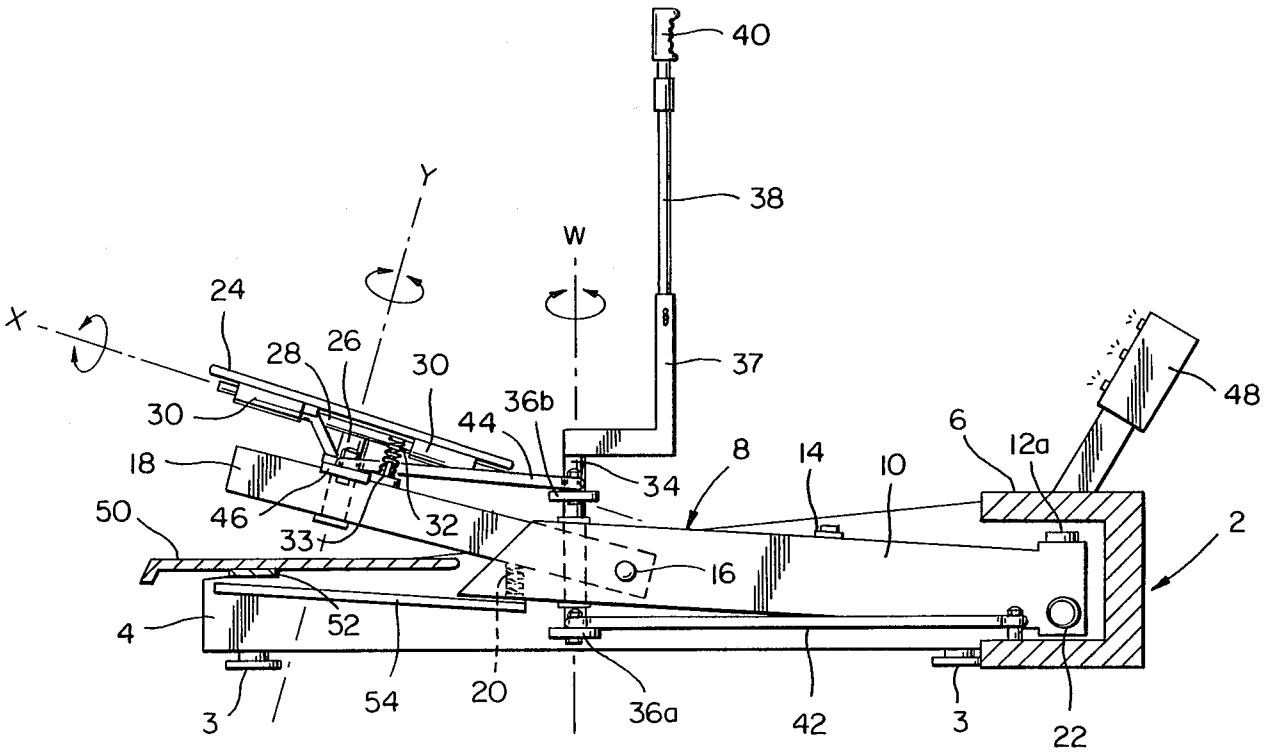
FIG. 4 is a partial schematic side view, partly in section of the machine of FIG. 1, as seen along section line II—II.

Referring to the detailed illustration of FIGS. 1 and 2, the basic equipment structure, which is able to be placed on the ground in a stable manner and is preferably composed of metallic box parts obtained by pressing and welding elements together, is illustrated. The structure is equipped with adjustable feet 3 near the ends of the side elements which can be used to incline the structure with respect to the ground. The form of the complete structure is a "C", and the side elements 4 are divergent, whilst the front part 6 is formed without a front wall, and is therefore chanelled. The above construction of the basic structure 2 provides a free space between the side elements 4. In the core in the front part 6 forming the channel, one end of a mobile arm 8 is centrally connected. As illustrated, arm 8 is made up of two hollow metallic side members 10, hinged using vertical pins **12*a* and 12*b*, to the front part 6 of the basic structure 2 and is symmetrical in this respect. The two side members 10 are connected together by a telescopic bar 14 which maintains the members in a parallel position, as specified above, or it is able to change their disposition making them convergent toward one another. A metallic beam 18 is inserted in each of the side members 10 and is hinged using the horizontal pin 16. Beam 18 extends obliquely upwards and is kept in this position by an elastic means 20 which is placed vertically under and inside side member 10. From the above description it is clear that mobile arm 8 is able to carry out an ascillation in the free space delimited by the basic structure 2, between the side elements 4, on a horizontal plane due to the possible rotation of the side members 10 on the pins connecting them to the basic structure 29 The arm 8 itself is capable of a slight oscillation, or vertical spring movement, at the same time, due to the rotation of the beam on the pin which connects it to the side member. Such rotation is obtained by overcoming the resistance of the elastic means 20**.

Elastic means 22 are fixed to both sides of mobile arm 8 and inside the core of the front part 6 of the basic structure 2. At rest, elastic means 22 extend to cover the complete distance between arm 8 and the side elements 4 of the basic structure 2. The elastic means 22, which are made up of helicoidal springs, have the function of absorbing kinetic energy produced by oscillating movement of the arm and of returning it at the end of travel. In this manner, means 22 facilitate the inversion of the direction of horizontal oscillation of the arm, giving it a regular action and at the same time limiting it to the space between the side elements 4 of the basic structure 2. These elastic means 22 can be of different rigidities to absorb and return the kinetic energy of the arm with an oscillation going from quick to slow according to requirements. Two boards 24 are placed near the free end of arm 8, and each one is placed on one of the beams 18 exiting from the hollow side members 10. Each of these boards 24, which act as skis, is made up of a rectangular metal plate with raised sides so that the user's feet can easily and safely rest on them during use. The boards 24 are freely connected to the metallic beams 18 by means of a first vertical pin 26 which goes through the beams 18, and a second horizontal pin 28, welded to the head of the first pin 26. The horizontal pin 28 is, in turn, freely inserted in bushes 30, which are then fastened to the lower wall of the boards 24. The insertion of horizontal pin 28 inside the bushes 30, and the insertion of the vertical pin 26 inside the beams 18, provides connection of the boards with the beams. The above mentioned boards are therefore allowed to rotate around the horizontal "x" and verticaly "y" axes, respectively, of the first and the second pin. As will be seen, these rotations of the boards 24, together with the vertical and horizontal oscillations of arm 8 to which they are connected, allow the user to simulate movements used in skiing techniques.

The rotation of boards 24 around the horizontal "x" axis occurs by overcoming the resistance of elastic means, represented by two small helicoidal springs 32, within which sticks 33, welded to the metallic beams at each side of the boards 24, are received. Sticks 33 are in correspondence with the vertical pin 26. These sticks, besides receiving the springs 32, limit the rotation of the boards 24 in both directions to within an angle between 15° and 30° and preferably equal to 20°.

Pins 34 are loosely inserted in the side members 10 in the area about halfway along arm 8. To the parts of arm 8 exiting from above and below the side member are welded two brackets **36*a* and 36*b* parallel to each other and which extend externally. The square arms 37 are welded to the heads of the vertical pins 37 which, in turn, receive vertically in their upper ends, two rods 38 inserted and fastened using screws to allow the rods to be adjusted for height. The rods 38 are fitted with grips 40 at their upper end, and the rods and the grips then function as ski poles or sticks. The rods 38 are also able to rotate together with pins 34 around their vertical axis "X". To the lower rods 36*a* are freely connected, for example by using pins with threaded ends to which the fastening nuts are screwed, bars 42. The other ends of bars 42 are connected to swivel and move, by means of other pins placed inside the cavity of the front part 6, relative to the basic structure 2. Other bars 44 have ends which are connected to the brackets 32 in the same manner. The other ends of bars 44 are connected to brackets 46 welded to the vertical pins 26 by means of which, as already mentioned, the boards 24 are connected to the arm. A further bar 47 is connected sideways to bracket 46 for swivelling. The other end of bar 47 is connected for swivelling approximately half way along and under boards 24. Bars 42 and 44 constitute a system of levers which transmit horizontal planar oscillating movement of the arm to the boards 24 and sticks 38, causing these elements to rotate respectively around the vertical axis "Y" and the counter vertical axis "W" with respect to the direction of oscillation of arm 8**.

The rotation of the sticks and the boards is also made synchronous by having bars 42 and 44, which transmit the oscillating movement of the arm to the sticks and boards, connected together by the vertical pins 34, which they have in common. Lastly, bars 47, which intervene when the rotation of the boards 24 on the horizontal "X" axis is greater than an angle between 10° and 25°, and preferably 20°, limit the rotation on the vertical "Y" axis of the boards.

As previously mentioned, the total movement of the above described piece of equipment allows the user to simulate, in a particularly realistic manner, the movements of skiing.

More specifically, when the user starts, movement of the arm gives the boards a side thrust, first in one direction and then in the other. The resulting oscillation of arm 8 gives a rapid simulation of a succession of curves to the right and the left, made even more realistic as the boards, which correspond to skis, are progressively oriented, because of the system of levers described above, so as to follow an ideal curve radius on the basis of the angle of the boards which correspond to the ski edges on the snow. At the same time, again due to the effect of the above mentioned levers, the rods which act as ski poles or sticks, move into a correct position which is proper with respect to the skier during a curve. Further, through intervention of the user, it is possible to simulate both the so called "loading" and "unloading" of weight on the inside and outside of the skis, because of the possible vertical oscillations of the arm. Also, ski edging can be simulated because of the possible rotations of the boards acting as skis about horizontal axis "X".

The above-described piece of equipment is also equipped with a simple electric circuit for detection and warning of wrong movements and for those carried out over an improper time span by the user. In detail, this circuit should be connected to the power line with the interposition of an active means, for example a relay, and is essentially made up of a series of contacts connected to warning means 51. For example, luminous warning means may be placed in a panel 48, on the basic structure 2, where it can be easily seen by the user. Contacts 49 are useful for the detection, according to whether they are closed or open, of the wrong or, alternatively, the correct use of the equipment, giving warnings through the luminous means. In particular, these contacts, as shown in the diagram in FIG. 1, may be placed near the limit switches of arm 8 to warn that the oscillating movement parallel to the ground has been carried out, between the hollow side members 10 and the beams 18 to warn that "loading" and "unloading"

has been carried out and to indicat the consequent correct weight distribution of the user on the boards 24 which act as the skis, between beams 18 and the boards 24 to warn that "edging" has been carried out and, finally, inside the sticks 38 as one end of the contact is connected to a positive connection and the other to a ground connection, to warn of the excessive and incorrect pressure exerted by the user on the stick grips. Lastly, the piece of equipment also includes a platform 50 placed and hinged by pins between the two side parts of the basic structure 2 under arm 8, so as to correspond with the boards 24. The platform 50 is kept slightly higher than the ground because of elastic means, and the lower part thereof is equipped with locators 52 which are able to work with a beam 54 carried by arm 8, and which extends axially and externally under platform 52. When the user loses his or her balance and places his or her feet on the platform whilst the piece of equipment is in movement, this part will lower using its locators with the beam carried by the arm, which will immediately block the oscillation of the arm, thus avoiding any possibility of an accident to the user. The equipment can also be equipped with means for adjustment, in particular of the the distance of the poles or sticks from the boards, and also for the curve radius of the boards during oscillating of the arm, by simply varying the disposition of the lever system. Naturally, in accomplishing the principle of the invetion, the parts used for its production and the form of actuation can be widely varied from the above description, without going beyond the present invention as defined by the claims which follow.

I claim:

1. Equipment for ski movement simulation comprising:

a basic structure which can be placed stably on the ground;

a mobile arm hinged to said basic structure and able to oscillate horizontally with respect to the ground;

two boards carried by said mobile arm on which a user places his or her feet, supported by the mobile arm near a free end thereof;

means connected to said basic structure which incline the basic structure with respect to the ground, the mobile arm capable of a slight vertical oscillation;

a restraint connecting the two boards to said mobile arm which permits rotation of said boards around horizontal and vertical hinged axes;

means for limiting the rotation of the boards around the horizontal axis to a maximum angle between 15° and 30°;

vertical rods connected to pins on the arm to overhang the arm in a position which allows the user to grip them, said vertical rods being able to rotate around a vertical axis of the pins on the arm;

means for transmitting horizontal movement of the mobile arm with respect to the ground respectively to the boards and vertical rods, the means for transmitting horizontal movement causing the vertical rods and the boards to rotate synchronously, around their respective vertical axes opposite to the direction of oscillation of the mobile arm;

means for causing the boards to carry out a smaller rotation on their vertical axis when contemporaneous rotation of the boards on the horizontal axis is greater than an angle between 10° and 25°;

elastic means, placed at the sides of the arm, between the arm and the basic structure to absorb, at an end of travel of said mobile arm, kinetic energy produced, and to invert the oscillation direction with respect to the ground of the arm by applying a force produced by the energy absorbed to said arm;

a detection circuit equipped with electrical contacts actuated by said mobile arm, said boards and said vertical rods; and warning means inserted in a panel on the basic structure, to be positioned in front of the user, which signals incorrect movements and movements carried out over an incorrect time span by the user.

2. Equipment according to claim 1, wherein the basic structure has a "C" shaped form and comprises diverging side elements and a front part without a front wall having a channel type conformation; the basic structure thereby including a free space between the side elements.

3. Equipment as defined by claim 2, wherein the means which incline the basic structure with respect to the ground are small feet placed under the structure near ends of the side elements.

4. Equipment as defined by claim 1, wherein said mobile arm is made up of two hollow parallel metallic side members connected together by means of a telescopic bar which maintains said side members in a parallel position and in positions in which said side members converge toward one another, said arm also including two metallic beams inserted inside the side members, which protrude and extend obliquely upwards and kept in that position by an elastic means provided vertically under said beams and inside the side members, said beams able to oscillate vertically around a pin which connects them to the side members.

5. Equipment as defined by claim 1, and further comprising a vertical pin which passes through the beams and a second horizontal pin welded to a head of the vertical pin and freely inserted inside bushes welded to a lower wall of the boards.

6. Equipment as defined by claim 1, wherein the boards are each formed from a rectangular metallic plate with raised edges.

7. Equipment as defined by claim 1, wherein the vertical rods are connected to pins by means of square arms in the upper end of which said vertical rods are inserted and fastened by screws, allowing said vertical rods to be adjusted in height.

8. Equipment as defined by claim 4, wherein the means for transmitting the horizontal movement of the arm to the boards and the rods are bars to, one end of each bar being removably swivel connected to the basic structure in the cavity in a front part of the basic structure, the other end of each bar freely connected to brackets which extend externally to vertical pins exiting from the side members, and by other bars, one end of each of the other bars being swivel connected to other brackets also carried by the vertical pins exiting from the side members, the othe end of each of the other bars being swivel connected to brackets welded to the vertical pins by which the boards are connected to the mobile arm.

9. Equipment as defined by claim 1, wherein the means for causing the boards to carry out a smaller rotation on the vertical axis are composed of bars swivel connected at one end to brackets carried by on vertical pins of the boards, whilst the other end of each bar is swivel connected in a median position under the boards.

10. Equipment as defined by claim 4, wherein the means for limiting the rotation of the boards around the horizontal axis comprise sticks welded to the metallic beams on both sides of the boards in correspondence to vertical pin of the boards, said sticks fitted with coaxial helicoidal springs with resistances which are overcome by the boards during rotation of the boards on the horizontal axis.

11. Equipment as defined by claim 10, wherein the sticks limit the rotation of the boards in both directions on the horizontal axis to an angle equal to 20°.

12. Equipment as defined by claim 1, wherein means for causing the boards to carry out a smaller rotation on their vertical axis intervene when the rotation of the boards on the horizontal axis reaches an angle equal to 15°.

13. Equipment as defined by claim 2, and further comprising a platform hinged between the side elements using pins, said platform placed under the arm in correspondence with the boards, the platform being kept slightly higher than the ground by elastic means and being fitted underneath with locators; and a beam carried by the arm, working with said locaters and extending axially and externally underneath the platform to block the oscillation of the arm.

14. Equipment according to claim 4, wherein the detection circuit is connected to a power line with a relay interpositioned between the circuit and the power line, the electrical contacts being placed respectively near limit switches of the arm, between the hollow side members and the metallic beams, between the metallic beams and the boards and inside the vertical rods, one end of said electrical contacts being connected to earth.

15. Equipment as defined by claim 14, wherein opening and closing of the electrical contacts cause the warning means carried on the panel to light up or be put out.

* * * * *